US006857721B2

(12) United States Patent
Salzer

(10) Patent No.: US 6,857,721 B2
(45) Date of Patent: Feb. 22, 2005

(54) FLUID CONTAINMENT SYSTEM INCLUDING AN INK REDIRECTION SURFACE

(75) Inventor: Mark L. Salzer, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 70 days.

(21) Appl. No.: 10/260,084

(22) Filed: Sep. 27, 2002

(65) Prior Publication Data

US 2004/0061745 A1 Apr. 1, 2004

(51) Int. Cl.[7] ..... B41J 2/165
(52) U.S. Cl. ..... 347/36
(58) Field of Search ..... 347/36, 35, 31, 347/29, 40, 47, 54; 216/16–17

(56) References Cited

U.S. PATENT DOCUMENTS

2002/0033860 A1 * 3/2002 Kubota et al. ..... 347/36

FOREIGN PATENT DOCUMENTS

| | | |
|---|---|---|
| EP | 0705699 B1 | 6/1998 |
| EP | 1000743 A2 | 5/2000 |

* cited by examiner

*Primary Examiner*—K. Feggins

(57) ABSTRACT

A fluid containment system includes an ink depository and a hood secured thereto. The hood includes an ink redirection structure for directing ink emitted from a printhead through a constrictive conduit into the ink depository.

28 Claims, 3 Drawing Sheets

FLUID CONTAINMENT SYSTEM INCLUDING AN INK REDIRECTION SURFACE

BACKGROUND

Printing mechanisms, such as inkjet printers, may use pens, which shoot drops of liquid colorant, referred to generally herein as "ink," onto a print medium, such as a page of paper. Each pen may have a printhead formed with very small nozzles through which the ink drops are fired. To print an image, the printhead may be propelled back and forth across the page, shooting drops of ink in a desired pattern as it moves. The particular ink ejection mechanism within the printhead may be implemented in a variety of different ways, such as by piezo-electric or thermal printhead technology.

To clean and protect the printhead, also called servicing or maintenance of the printhead, a service station mechanism may be mounted within the printer. During cleaning the printhead may be moved over the service station and ink may be ejected or "purged" from the printhead nozzles toward a spittoon or ink collection chamber of the service station. The ejected ink may combine with surrounding air to create an ink aerosol that is not easily contained with the spittoon. The uncontained ink aerosol may damage internal components of the printing mechanism or contaminate sites within the printing mechanism such as the input or outputs trays, or print media held therein. In the case of color printing mechanisms, an ink aerosol from one colored ink printhead may emerge from the spittoon and contaminate an ink printhead of a different colored ink, thereby reducing the print quality of each image printed thereafter.

SUMMARY OF THE INVENTION

A fluid containment system includes an ink depository and a hood secured thereto. The hood includes an ink redirection structure for directing ink emitted from a printhead through a constrictive conduit into the ink depository.

DESCRIPTION OF THE PREFERRED EMBODIMENTS

Figure 1:
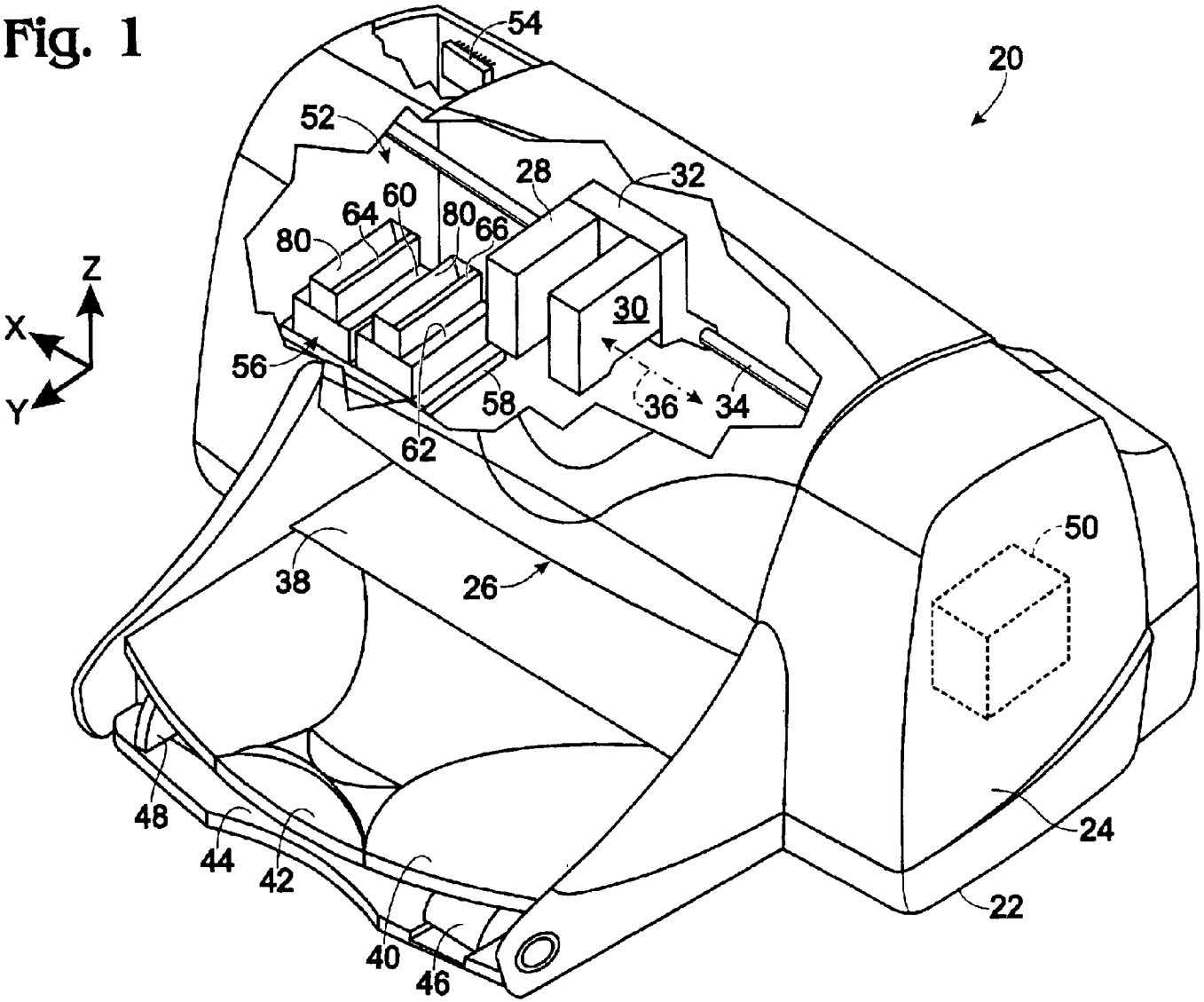
FIG. 1 is a perspective view of one embodiment of a printing mechanism that includes a service station including an ink collection reservoir with a hood positioned thereon.

FIG. 1 illustrates one embodiment of a printing mechanism, here shown as a printer 20, which may be used for the printing of business reports, correspondence, desktop publishing, and the like, in an industrial, office, home or other environment. A variety of printing mechanisms is commercially available, such as inkjet printers and laser printers, for example. Some of the printing mechanisms that may use embodiments of the present invention include plotters, portable printing units, copiers, cameras, video printers, and facsimile machines, to name a few. For convenience, the concepts of the printing mechanism are illustrated in the environment of an inkjet printer 20.

While it is apparent that the printer components may vary from model to model, inkjet printer 20 may include a chassis 22 surrounded by a housing, also called a body or a casing enclosure 24, which may be manufactured of plastic. A sheet or sheets of print media may be fed through a print zone 26 and beneath a first printhead 28, also referred to as a printing means and an ink ejection device, and a second printhead 30. The one or more printheads may be supported on a printhead carriage 32 which is supported on a carriage rod 34 extending through the housing and defining a scanning axis 36. The print media sheet 38 or sheets may be any type of suitable material, such as paper, card-stock, cardboard, transparencies, mylar, and the like, but for convenience, the illustrated embodiment is described using paper as the print medium.

In the embodiment shown, sheet 38 is shown exiting print zone 26 and being deposited on an output tray 40 having a sliding length adjustment lever 42. Positioned below output tray 40 is an input tray 44 including a length adjustment device, such as a sliding length adjustment lever 46 and a width adjustment device, such as a sliding width adjustment lever 48, for accommodating different sizes of print media, including letter, legal, A-4, and envelopes, for example.

An actuation device, such as a motor 50 (shown schematically in dash lines), may be positioned within housing 24 and may operate to move printhead carriage 32 along carriage rod 34, in the direction of scanning axis 36, from print zone 26 into a servicing region 52. For ease of illustration, printhead carriage 32 is shown in print zone 26 so that servicing region 52 may be viewed. A capping station, not shown, may be separately positioned on an opposite side of the printer, i.e., along carriage rod 34 and adjacent motor 50. A printer controller, illustrated schematically as a microprocessor 54, may be positioned within housing 24 and may receive instructions from a host device, typically a computer, such as a personal computer (not shown) for operating motor 50 and printheads 28 and 30. Many of the printer controller functions may be performed by the host computer, by the electronics on board the printer, or by interactions therebetween. As used herein, the term "printer controller 54" encompasses these functions, whether performed by the host computer, the printer, an intermediary device therebetween, or by a combined, interaction of such elements. The printer controller 54 may also operate in response to user inputs provided through a key pad (not shown) located on an exterior of housing 24. A monitor coupled to the computer host may be used to display visual information to an operator, such as the printer status or a particular program being run on the host computer.

Still referring to FIG. 1, service region 52 may comprise a service station 56, also referred to herein as a cleaning station or a maintenance station, movable into position adjacent printheads 28 and 30 when the printheads are moved into the service region. Service station 56, also referred to as a servicing means, may include a support sled 58 that movably supports an ink receiving means such as a first spittoon 60, which functions as an ink collection chamber. The support sled 58 may include wipers, wiper scrapers, and/or absorbers, not shown, that may be moved back and forth across the printheads to service the printheads 28 and 30. Actuation of the sled 58 may be accomplished with a drive gear and a mating gear rack, not shown, that may be positioned beneath the support sled. The support sled 58 may be held stationary adjacent the printhead 28 during "spitting" by the pens so that the printhead is properly aligned with its corresponding spittoon. In the embodiment shown, the support sled 58 further includes a second spittoon 62 so that each of the printheads will align with a corresponding spittoon during the servicing routine. Each of the spittoons 60 and 62 may include a surface directing means, such as hoods 64 and 66, respectively, that change the trajectories of ink droplets emitted from printheads 20 and 30.

Figure 2:
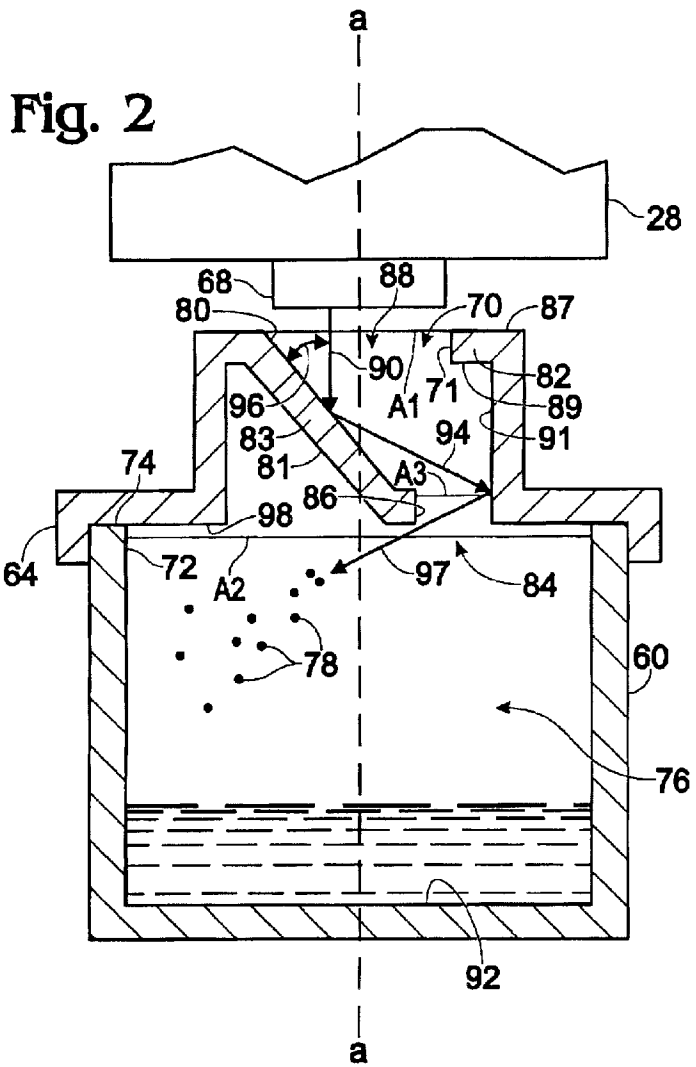
FIG. 2 is a side cross sectional view of one embodiment of the hood and reservoir of the printing mechanism of FIG. 1.

FIG. 2 illustrates a side cross sectional view of one embodiment of the printing mechanism of FIG. 1, wherein a nozzle orifice plate 68 of first printhead 28 is positioned in servicing region 52, above and aligned with an upper hood opening 70 of first hood 64. Upper hood opening 70 has a perimeter 71 which defines an area A1 that may be sized and shaped to efficiently capture ink particles ejected from printhead 28. As shown in FIG. 2, hood 64 includes an upper opening 70 defined by a guide structure 83 and a stop structure 82. Upper guide structure 83 has an upper guide surface 80 and an opposed underside surface 81. Stop structure 82 includes an upper surface 87 and an underside surface 89. Ink particles ejected from printhead 28 tend to form an aerosol that undesirably may become deposited on various components of printer 20. Therefore, capturing ink particles ejected from printhead 28 during servicing of the printhead is very desirable. During servicing, area A1 is generally positioned proximate to printhead 28 so that ink particles ejected from printhead 28 may ejected through opening 70 of hood 64. During servicing of the printhead 28, area A1 is generally oriented perpendicularly to directional ray 90, and is shown edge-on in FIG. 2. Ray 90 is also coincident with a normal of area A1, where a normal is defined as a line that is perpendicular to the plane defined by area A1. Hood 64 is secured to depository opening 72, of spittoon 60, and funnels ink particles ejected from the printhead 28 during servicing into reservoir 76 of spittoon 60. Opening 72 has a perimeter 74 that defines an area A2 of opening 72 which is generally perpendicular to direction ray 90. Area A2 may be quite large compared to area A1, and is shown edge-on in FIG. 2. By way of example, area A2 may be more than four times larger than the area A1.

At least fifty percent, and in particular, approximately seventy five percent, of the area A2 may be blocked by the underside surface 81 of guide structure 83. By way of example, at least eighty percent, and in particular, approximately ninety five percent, of the area A2 may be occluded or blocked by a combination of underside surface 81 and stop surface 82. The difference in size between areas A1 and A2 facilitates capturing or trapping any ink particles or ink aerosols that enter reservoir 76 of spittoon 60, as described below.

Guide structure 83 and stop structure 82 are stationary with respect to hood 64, and do not pivot or rotate within the hood. Hood 64 includes underside surface 89 and deflection surface 91. Surface 89 generally meets and is coterminous with deflection surface 91 at an angles of about 90 degrees, although the scope of the invention includes joining these surfaces at other angles, as may be required to suit the needs of a particular application. Underside surface 81 and deflection surface 91 collectively define a lower hood opening 84 having a perimeter 86. Perimeter 86 defines area A3 of opening 84, where area A3 is represented edge-on as a line in FIG. 2. Surfaces 80 and 89 extend between opening 70 and opening 84 to form a progressively narrow or constricted conduit 88. Area A1 of upper hood opening 70 may be large compared to area A3 of lower hood opening 84 and, in particular, the area A1 may be more than two times larger than area A3. Area A2 may be eight times larger than area A3. Thus, it may be appreciated that hood 64 defines a funnel shaped, constricted conduit 88 that extends and becomes progressively more restricted from opening 70 to opening 84. The underside surface 89 of stop structure 82 serves as a ridge that helps to inhibit the flow of any ink particles 78 out of hood 64 after they enter channel 88.

Still referring to FIG. 2, during maintenance of printhead 28, the printhead may purge or eject ink particles 78 along a trajectory represented by directional ray 90, which may be oriented perpendicularly with respect to nozzle orifice plate 68 and to a lower surface 92 of reservoir 76 of spittoon 60. If ink particles 78 are allowed to directly enter reservoir 76 of spittoon 60 without hood 64 positioned thereon, the ink particles 78 may strike lower surface 92 of the spittoon and be directed back out of the opening 70 the hood 64. The ink particles 78 may contaminate and possibly damage components of the printer, thereby reducing future print quality. Therefore, containing ink particles 78 in reservoir 76, especially when the ink particles are in an aerosol state, is very desirable.

In the embodiment shown in FIG. 2, stop structure 82 is shown by way of example to be oriented generally perpendicularly with respect to directional ray 90. However, the scope of the invention also allows for stop structure 82 to be positioned at an angle in the range of about one to ninety degrees with respect to ray 90, as required to suit the needs of a particular application.

In order to reduce or inhibit the quantity and/or volume of ink particles that may escape from spittoon 60, guide surface 80 of guide structure 83 redirects movement of ink particles 78 from a trajectory along ink directional ray 90 to a second trajectory or direction that is different from ray 90, as for example, along redirection ray 94. Ink particles 78 may enter spittoon 60 along a ray that is other than perpendicular to lower surface 92 of the spittoon so that the ink particles 78 are not easily deflected upwardly and out of the spittoon. In the embodiment shown, guide surface 80 is inclined with respect to directional ray 90 such that guide surface 80 defines an acute angle 96 therebetween. Angle 96 may be in a range of one to eighty nine degrees, but may more typically be in a range of forty five to eighty nine degrees so as to direct the ink particles 78 along a trajectory oriented downwardly and away from upper hood opening 70, as for example, in the direction of redirection ray 94. Any ink particles 78 that are deflected off surface 80 in the direction of ray 90 and traveling fast enough, may then be deflected off surface 91 of hood 64, and then be directed into reservoir 76 along directional ray 97. Guide surface 80 of guide structure 83 is oriented at an inclined angle with respect to ink direction ray 90 and surface 92 so that when the ink particles 78 enter spittoon 60, the ink particles do not readily escape from the spittoon, but instead are captured or trapped in reservoir 76.

Lower hood opening 84 may be offset from upper hood opening 70, with respect to axis a-a that is parallel to a normal of area A1. Such an offset hinders ink particles 78 from escaping reservoir 76 of the spittoon 60. In particular, opening 84 and opening 70 may be offset from one another such that opening 72 of the spittoon is significantly blocked when viewed from inside the spittoon along a direction parallel and opposite to the direction of ray 90. Due to the relatively smaller size of area A3 of lower hood opening 86 relative to the size of area A2 of spittoon opening 72, even if ink particles 78 are deflected upwardly out of spittoon 60, the ink particles have a strong possibility of contacting an underside 98 of hood 64, rather than escape through restricted opening 84. Thus, particles that enter reservoir 76 are likely to be contained therein. Any particles that may escape from reservoir 76 back into conduit 88 may be prevented from escaping hood 64 by underside 89 of stop structure 82.

The spittoon hood 64 as shown reduces ink particle contamination within printer 20 in two distinct manners. Guide surface 80 of hood 64 redirects ink particles 78 ejected from printhead 28 so that ink particles 78 are not readily deflected upwardly and out of spittoon 60. Second, redirection surface 80 of hood 64 guides ink particles 78 through restricted opening 84 in the hood and into the large interior space of reservoir 76 of spittoon 60. The configuration of underside surface 81 of guide structure 83 and underside surface 89 of stop surface 82 inhibit the escape of ink particles 78 out of reservoir 76 and/or through hood 64. Moreover, in the embodiment shown, hood 64 provides a first opening 84 and another opening 70. Openings 70 and 84 are offset from one another with respect to axis a-a. The offset relation of openings 84 and 70 further inhibits escape of ink particles 78 from the spittoon 60.

The positions and orientations of surfaces 81 and 82 facilitate generally one-way flow of ink particles 78 into collection chamber 60, while inhibiting the flow of the ink particles 78 back through the hood or chimney 64. Due to the small size of restricted opening 86 of spittoon 60, the ink particles 78 that enter reservoir 76 tend to become trapped therein. The combination of angled surfaces of hood 64 provides a virtual "lid" for the reservoir 76 of spittoon 60 collection chamber so that ink particle contamination of the printer and/or printer components is markedly reduced.

Figure 3:
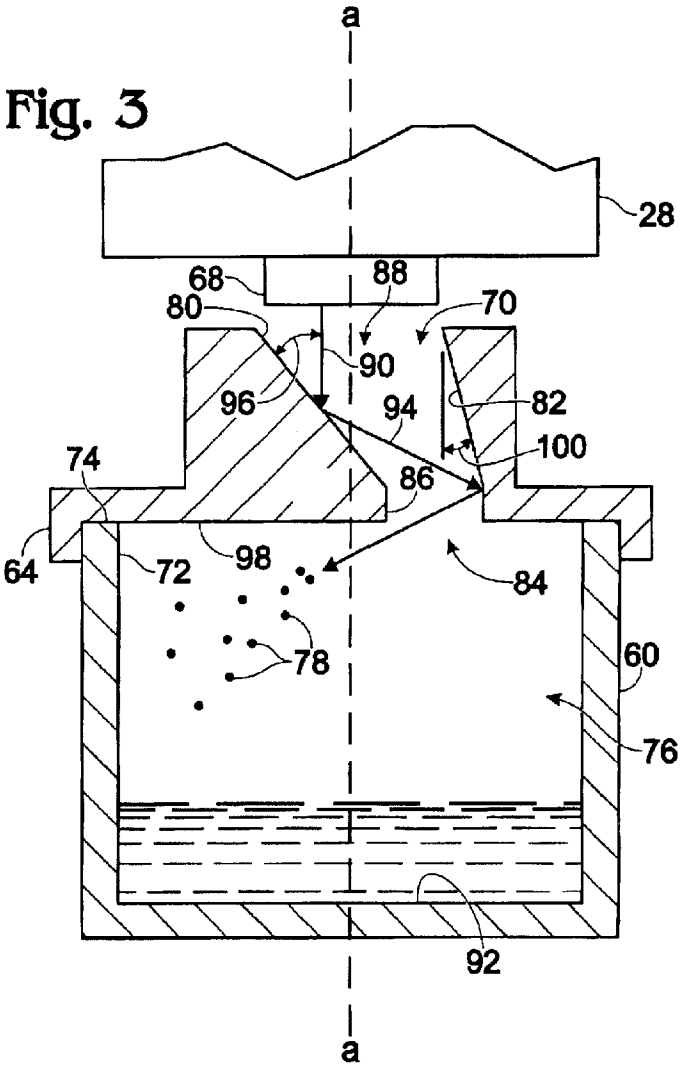
FIG. 3 is a side cross sectional view of another embodiment of the hood and reservoir of the printing mechanism of FIG. 1.

FIG. 3 illustrates a side cross sectional view of another embodiment of the printing mechanism of FIG. 1. In this embodiment, inclined stop surface 82 defines an angle 100 with respect to directional ray 90. Guide surface 80 and stop surface 82 form a funnel-shaped, i.e., constricted conduit 88 for channeling ink particles 78 that becomes increasingly more constricted as it extends from upper hood opening 70 towards lower hood opening 84. The surface 80 redirects ink particles 78 from a trajectory along direction ray 90 to a trajectory along redirection ray 94. Then, surface 82 may deflect the ink particles 78 toward restricted hood opening 84 in the direction of ray 97 and into reservoir 76. Hood opening 70 and hood opening 84 are offset from one another, i.e., not aligned with one another along a direction parallel to axis a-a so that ink particles 78 are significantly hindered from escaping reservoir 76 of spittoon 60, and generally are trapped therein.

Figure 4:
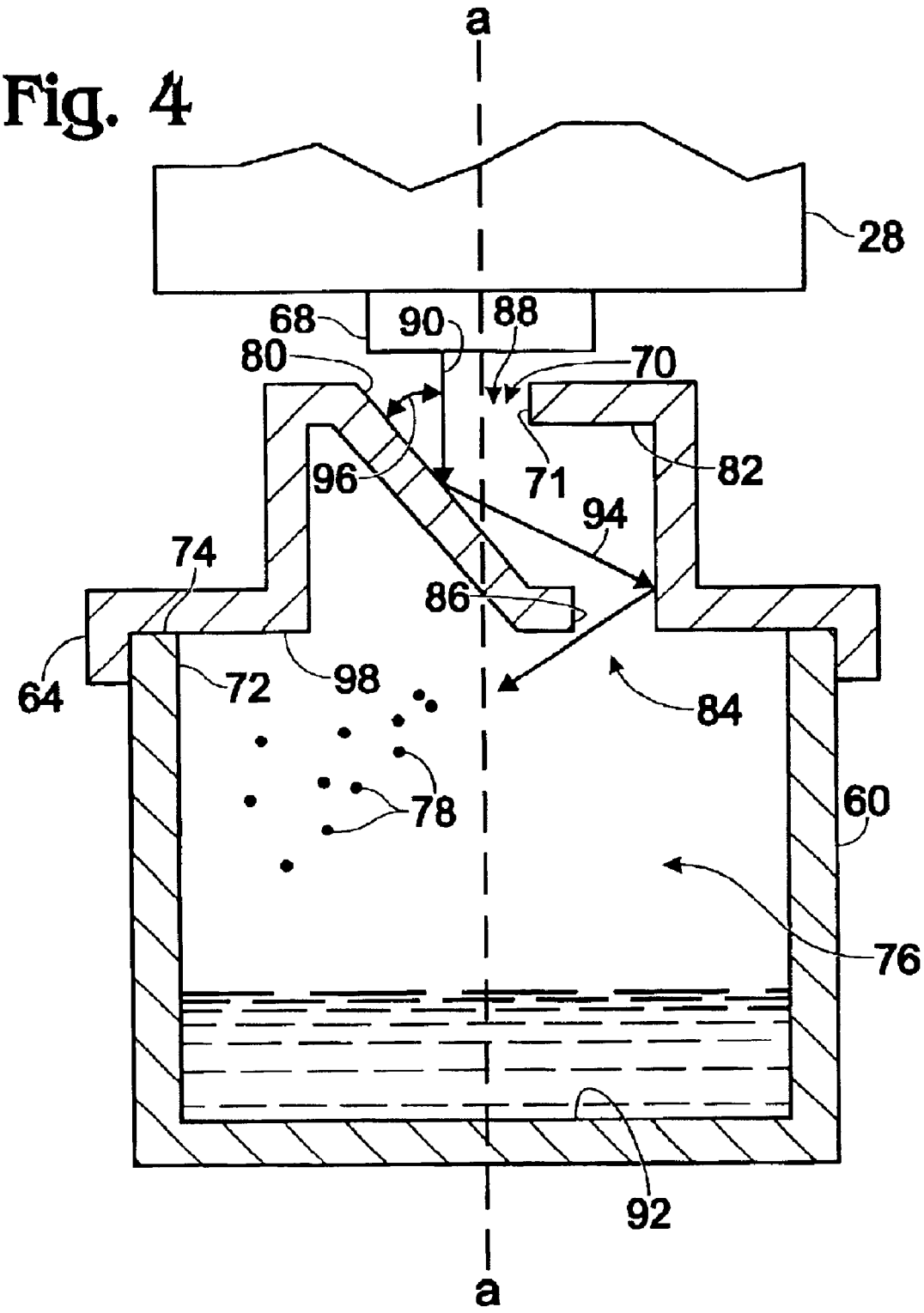
FIG. 4 is a side cross sectional view of another embodiment of the hood and reservoir of the printing mechanism of FIG. 1.

FIG. 4 illustrates a side cross sectional view of another embodiment of the printing mechanism of FIG. 1. In this embodiment, stop surface 82 may be generally parallel to lower surface 92 of spittoon 60 and slightly longer than the corresponding length of stop surface 82 shown in FIG. 1. Upper cap opening 70 of hood 64, therefore, when viewed along a direction parallel to axis a-a is generally offset from lower cap opening 84 of the hood. Thus, when viewed along axis a-a in a direction generally perpendicular to lower surface 92 of the spittoon 60, portions of opening 70 and 84 overlap one another. Accordingly, in this embodiment, there is no direct linear path of escape for ink particles 78 out of spittoon 60 along a linear path parallel to axis a-a Herein described are embodiments of a printing mechanism 20 that include a service station 56 having an ink depository 60 adapted for receiving ink particles 78 purged from a printhead 28 during servicing thereof and a hood 64 secured to the ink depository. The hood 64 defines a stationary ink redirection surface 80 for changing a direction of movement of ink emitted from the printhead so as to trap the ink particles 78 within the ink reservoir.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described herein without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

We claim:

1. A fluid containment system, comprising:

an ink depository including an opening; and a hood secured to said ink depository and including an ink redirection structure for directing ink emitted from a printhead through a constrictive conduit into said ink depository, said redirection structure partially blocking said depository opening.

2. The fluid containment system of claim 1 wherein said hood includes a funnel for directing ink into said ink depository.

3. A fluid containment system, comprising:

an ink depository; and a hood secured to said ink depository and including an ink redirection structure for directing ink emitted from a printhead through a constrictive conduit into said ink depository;

wherein said ink depository has a depository opening having a first area and said redirection structure is positioned at an acute angle with respect to a normal of said first area and partially blocks said depository opening.

4. The fluid containment system of claim 3 wherein said hood further includes a stationary stop structure positioned at an angle in a range of about eighty five to ninety degrees with respect to said normal for inhibiting ink from escaping said hood.

5. The fluid containment system of claim 4 wherein at least ninety five percent of said first area is blocked by said guide structure and said stop structure.

6. The fluid containment system of claim 4 wherein said redirection structure and said stop structure collectively define an upper hood opening that defines a second area, and a lower hood opening that defines a third area, said second area is larger than said third area, and said upper hood opening and said lower hood opening are offset from one another.

7. The fluid containment system of claim 3 wherein at least fifty percent of said first area is blocked by said redirection structure.

8. The fluid containment system of claim 3 wherein said redirection structure is oriented at an acute angle in a range of one to eighty nine degrees with respect to said normal.

9. A fluid containment system, comprising:

a spittoon having a first opening positioned to receive ink particles ejected from a printhead; and a closure element secured to a perimeter of said first opening, said closure element including a second opening defining a first area and third opening defining a second area, and a guide structure that extends between said second and third openings and is positioned at an acute angle with respect to a normal of said first area for partially blocking said second opening.

10. The fluid containment system of claim 9 wherein said first area is larger than said second area.

11. The fluid containment system of claim 9 wherein at least seventy five percent of a third area defined by said first opening is blocked by said guide structure.

12. The fluid containment system of claim 9 further comprising a stop structure oriented generally perpendicularly with respect to said normal, and wherein at least ninety five percent of said first opening is blocked by said guide structure and said stop structure.

13. The fluid containment system of claim 9 wherein said guide structure is positioned at an acute angle in a range of forty five to eighty nine degrees with respect to said normal.

14. A fluid containment system comprising:

an ink reservoir including a reservoir opening that receives ink ejected from a printhead; and a constricted conduit mounted to said ink reservoir and partially blocking said reservoir opening, said conduit for funneling said ink into said ink reservoir and restricting said ink from exiting said ink reservoir.

15. The printing mechanism of claim 14 wherein said constricted conduit includes an inlet aperture having an area and a guide surface inclined with respect to a normal of said area.

16. The printing mechanism of claim 15 wherein said inlet aperture has a perimeter defined by guide surface inclined with respect to a normal of said area; and further includes a stop structure.

17. A fluid containment system, comprising:

first means for receiving ink through an opening and storing said ink; and second means secured to said first means for funneling ink emitted from a printhead into said first means, said second means at least partially blocking said opening.

18. The fluid containment system of claim 17 wherein said second means includes a constricted conduit for funneling ink into said first means.

19. A fluid containment system, comprising:

first means for receiving and storing ink; and second means secured to said first means for funneling ink emitted from a printhead into said first means;

wherein said first means is an ink depository having a depository opening that defines a first area and a redirection structure positioned at an acute angle with respect to a normal of said first area, wherein said redirection structure partially blocks said depository opening.

20. The fluid containment system of claim 19 wherein said second means includes a hood having a stationary stop structure positioned at an angle in a range of eighty five to ninety degrees with respect to said normal for inhibiting ink from escaping said hood.

21. The fluid containment system of claim 20 wherein at least ninety five percent of said first area is blocked by said redirection structure and said stop structure.

22. The fluid containment system of claim 20 wherein said redirection structure and said stop structure collectively define an upper hood opening and a lower hood opening, said upper hood opening defining a second area larger than a third area defined by said lower hood opening, and wherein said upper hood opening and said lower hood opening are offset from one another.

23. The fluid containment system of claim 19 wherein at least fifty percent of said first area is blocked by said redirection structure.

24. The fluid containment system of claim 19 wherein said redirection structure is oriented at an acute angle in a range of one to eighty nine degrees with respect to said normal.

25. A method for containing ink particles, comprising the steps of:

receiving ink particles directed along a trajectory in a constricted conduit;

directing said ink particles though a constricted conduit oriented in a direction that is different from said trajectory;

accumulating said ink particles received from said conduit in a reservoir having an opening wherein said constructed conduit at least partially blocks said opening.

26. The method of claim 25 further comprising the step of inhibiting said ink from exiting said reservoir.

27. The method of claim 25 further comprising the step of positioning said conduit near a printhead for receiving ink particles ejected from said printhead.

28. A printing mechanism, comprising:

a housing;

a carriage rod mounted to said housing;

a printhead movably mounted on said carriage rod;

a spittoon having a spittoon opening positioned to receive ink particles ejected from said printhead; and a closure element secured to a perimeter of said spittoon opening, said closure element including an upper opening having an area, and a guide structure positioned at an acute angle with respect to a normal of said area for partially blocking said spittoon opening for directing said ink particles into said spittoon and for inhibiting said ink particles from exiting said spittoon.

* * * * *